US006378168B1

(12) United States Patent
Brady et al.

(10) Patent No.: US 6,378,168 B1
(45) Date of Patent: Apr. 30, 2002

(54) MULTI-SECTIONED COILABLE SHAFT

(76) Inventors: Robert A. Brady, 5872 Brady Trail; Joseph S. Murphy, III, 104 Executive 10th Ave., both of Sebring, FL (US) 33872

( * ) Notice: Subject to any disclaimer, the term of this patent is extended or adjusted under 35 U.S.C. 154(b) by 0 days.

(21) Appl. No.: 09/709,044

(22) Filed: Nov. 10, 2000

(51) Int. Cl.[7] ..... A45C 13/22; B25G 1/04
(52) U.S. Cl. ..... 16/110.1; 16/436; 16/900
(58) Field of Search ..... 16/110.1, 436, 16/429, 900; 15/143.1, 144.1, 144.2, 144.3, 144.4; 403/108, 359, 365, 377; 248/188.6; 135/65, 66, 74, 114; 81/489

(56) References Cited

U.S. PATENT DOCUMENTS 883,985 A * 4/1908 Suva ..... 294/99.1
1,348,145 A * 8/1920 Arden ..... 15/111
2,379,577 A * 7/1945 Harsted ..... 135/65
2,705,015 A * 3/1955 Langlais ..... 135/114
3,669,133 A * 6/1972 Hyman ..... 135/74
5,775,021 A * 7/1998 Weiss ..... 135/65

* cited by examiner

*Primary Examiner*—Chuck Y. Mah
(74) *Attorney, Agent, or Firm*—Dennis G. LaPointe; Mason & Associates, P.A.

(57) ABSTRACT

A multi-sectioned coilable shaft which can be turned into a rigid shaft if desired, or be loosened to allow for the coilable storage of the shaft. The device has a handle and a cam lever fastened to one end of a cable. Along the cable are a plurality of cable spacers. A cable stop is fastened to the other end of the cable which captures the spacers on the cable and acts as the attachment mounting device. Adjustment is provided near the handle to allow for loosening of the cable or to allow for tensioning of the cable, when the cam lever is activated to draw the spacers tightly together to form a rigid shaft.

6 Claims, 4 Drawing Sheets

MULTI-SECTIONED COILABLE SHAFT

BACKGROUND OF THE INVENTION

Field of the Invention

The present invention relates to a multi-sectioned coilable shaft that is flexible and has many uses. The invention is particularly useful as a fish gaff, walking stick, magnet handle, scuba diver's tool, extended light handle, and any application that requires a rigid shank or shaft in one state, and a relaxed coilable state for storage or for transportation.

SUMMARY OF THE INVENTION

The present invention is a multi-sectioned coilable shaft that is flexible and has many uses.

It a multi-sectioned shaft which includes an elongate hollow handle. The elongate hollow handle has means for holding a shaft to the elongate hollow handle; the shaft includes a cable with an upper cable end connector attaching the cable to the means for holding the shaft to the elongate hollow handle.

A plurality of cable spacers, each with a longitudinal aperture there through is included. Each aperture is sized so as to allow each cable spacer to slide along the cable. The cable spacers have a conical end portion on one end of the cable spacer and a second aperture concentric to the longitudinal aperture forming an indented receiving portion at an opposite end of the cable spacer. The conical end portion and the indented receiving portion are defined such that the conical end portion of one of the cable spacers is capable of detachably engaging the indented receiving portion of an adjoining cable spacer.

The invention also includes adjusting means for adjusting cable tension. The adjusting means is located proximate the means for holding the shaft to the handle and between the means for holding the shaft to the handle and the plurality of cable spacers. When the adjusting means is loosened, the shaft is caused to become coilable as the cable spacers separate and when the adjusting means is tightened, the shaft is caused to become rigid as the cable spacers are engaged with each other.

The means for holding the shaft to the elongate hollow handle is typically an elongate cam lever, the elongate cam lever being sized to slide inside the elongate hollow handle. The elongate cam lever has a flared first end and a cam shaped second end. The flared first end is sized greater than an inside cross-sectional dimension of the elongate hollow handle such that the flared first end acts as a stop for preventing said flared first end from entering the elongate hollow handle. The upper cable end connector is pivotally engaged to the cam shaped second end.

When the elongate cam lever is pulled through the elongate hollow handle from the flared first end, the elongate cam lever is pivotally rotated to draw tension on the cable as the adjusting means engages the handle, thereby rendering the shaft rigid.

The adjusting means for adjusting cable tension typically includes an adjusting screw having a hollow interior for the slidable passage of the cable there through, and a knob having a hollow interior for the slidable passage of the cable there through. The adjusting screw is adjustably engagable with the adjusting knob and has a conically shaped end for engagement with the indented receiving portion of an adjacent cable spacer.

The elongate hollow handle preferably has an optional outwardly directed flared portion at one end, in which case the elongate hollow handle includes a notched portion in the outwardly directed flared portion. The flared first end of the elongate cam lever engages the flared portion of the elongate hollow handle thereby preventing the elongate cam lever from further travel into the elongate hollow handle. The notched portion typically extends into the handle to the generally straight surface portion of the elongate hollow handle. In this configuration, the notched portion serves to facilitate the folding over of the elongate cam lever on to the elongate hollow handle exterior surface by a cam action which locks the shaft in a rigid position.

The invention further comprises a lower cable end connector which is attached to the cable. The lower cable end connector has means for detachably attaching an object such as a spear, hook, magnet, tools such as screw drivers, socket sets, and many other working devices. The lower cable end connector further has means for engaging and receiving the conical end portion of at adjacent cable spacer. The means for engaging and receiving the conical end portion of the adjacent cable spacer is a second indented portion sized to receive the conical end portion.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE INVENTION

Figure 1A:
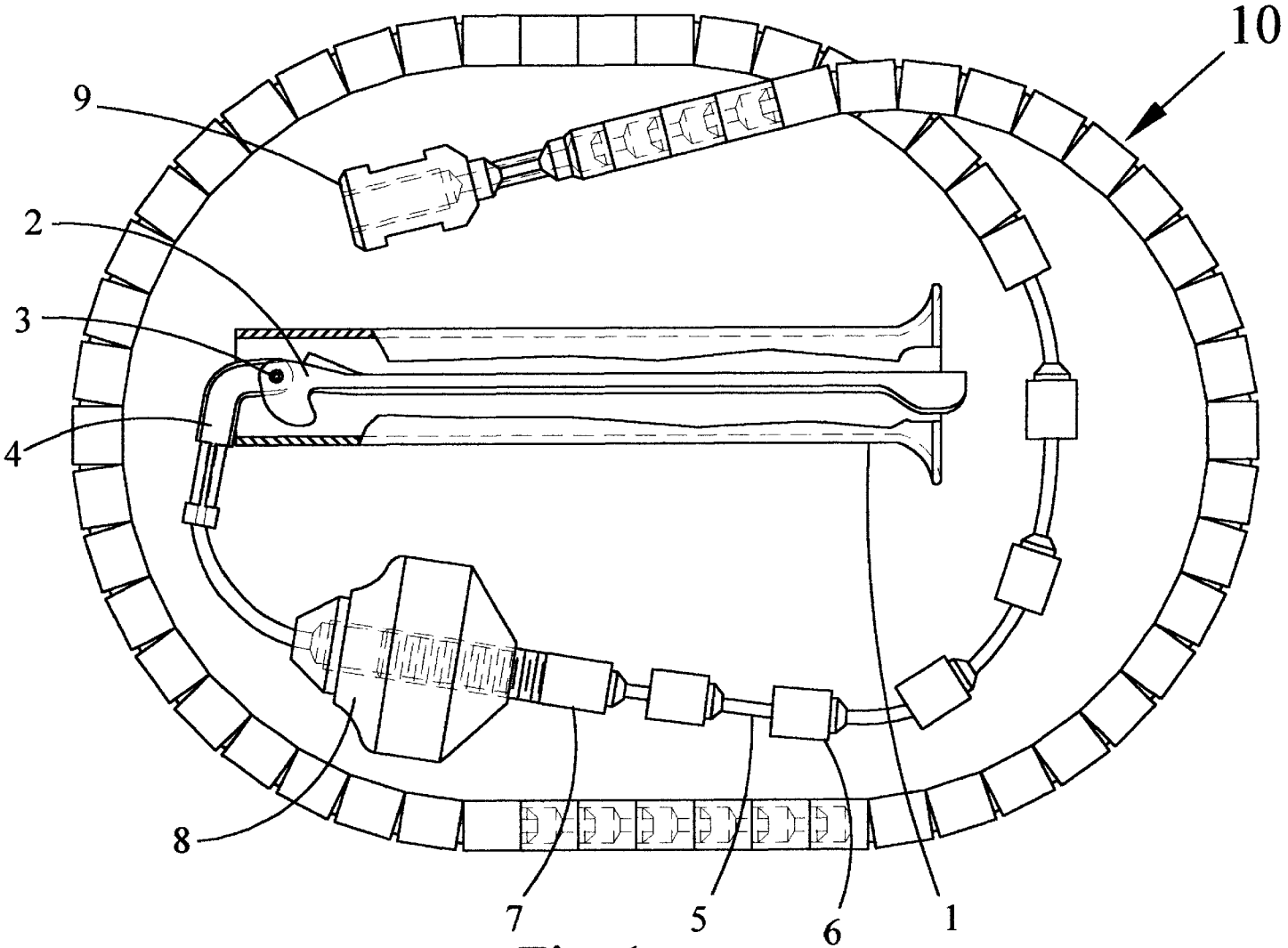
FIG. 1*a* is an extended view of the device in a coiled state.
Figure 1B:
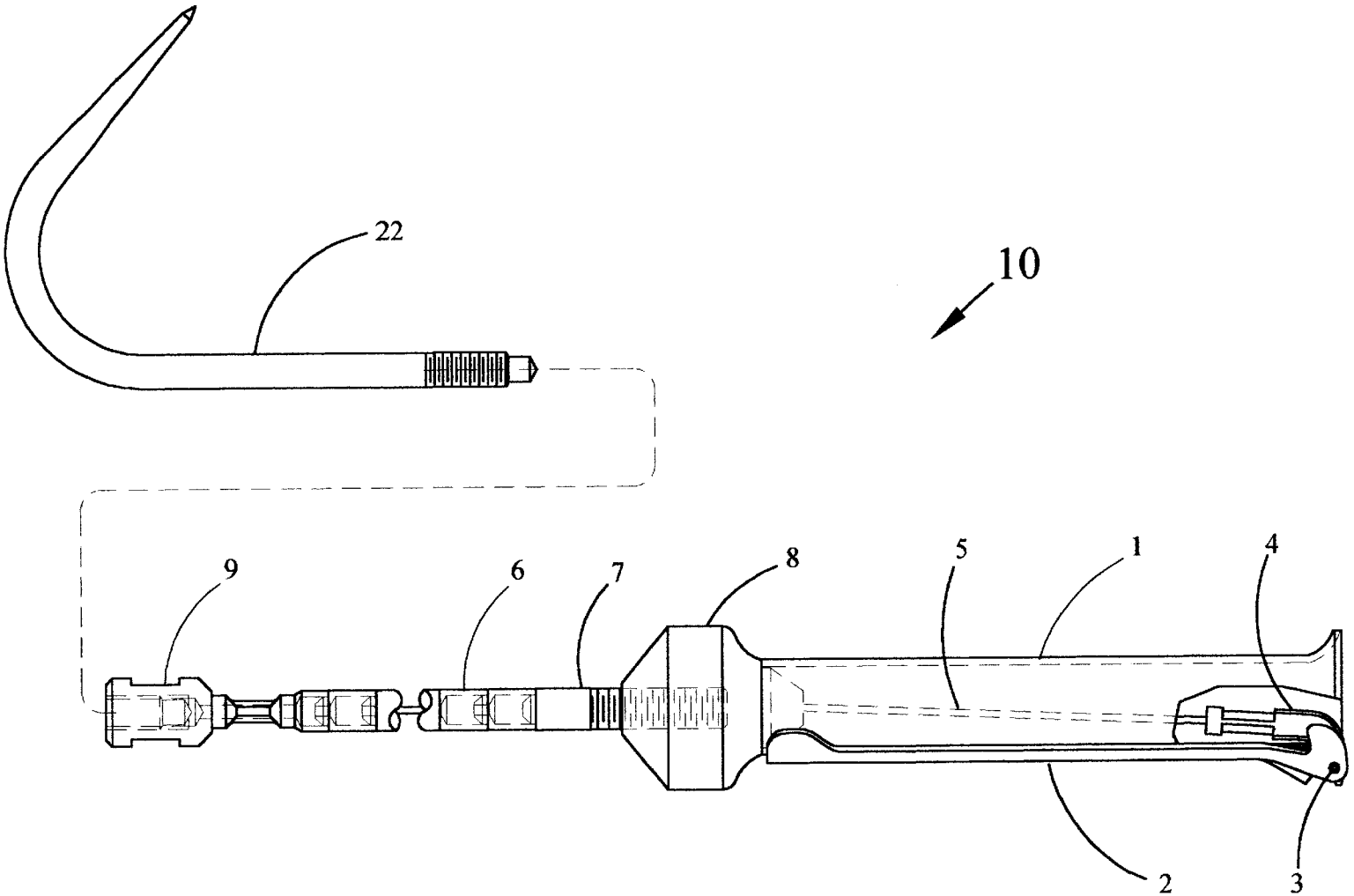
FIG. 1*b* is a view of the device in its extended rigid state.
Figure 1C:
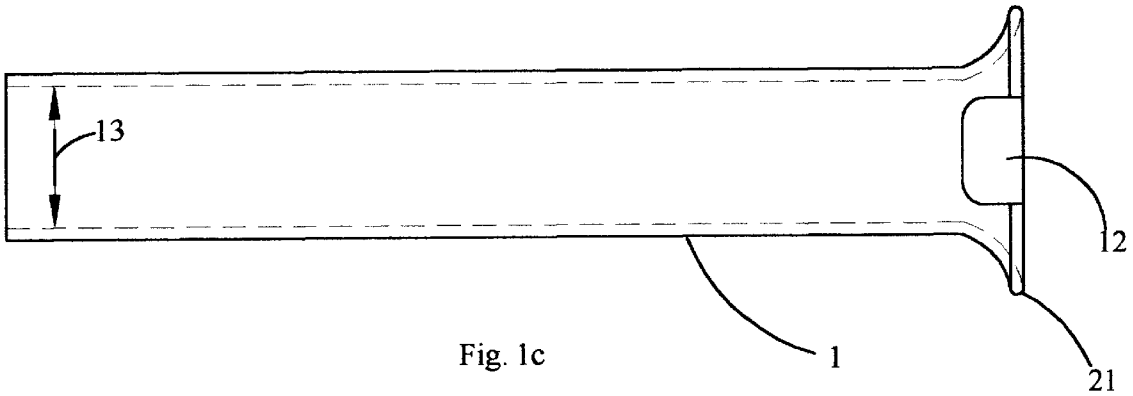
FIG. 1*c* shows the handle of the device.

Referring now to the drawings, in particular FIGS. 1*a*–1*c*, the invention which is a multi-sectioned coilable shaft and is depicted generally as 10.

Figure 3:
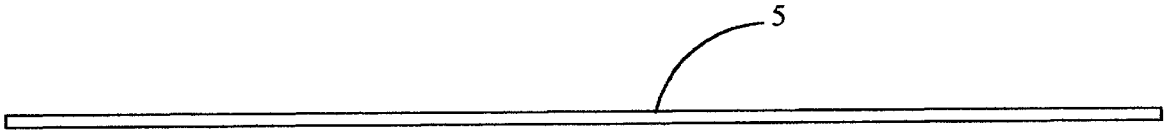
FIG. 3 is an extended view of the cable used in the device.
Figure 6:
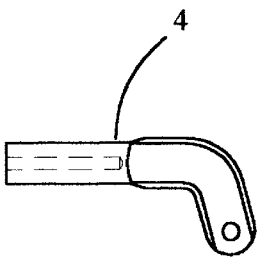
FIG. 6 shows the upper cable end of the device.

The invention 10 includes an elongate hollow handle 1. The elongate hollow handle 1 has means for holding a shaft to the elongate hollow handle. The shaft 10 includes a cable 5, FIG. 3, with an upper cable end connector 4, FIG. 6, attaching the cable 5 to the means for holding the shaft to the elongate hollow handle 1.

Figure 2:
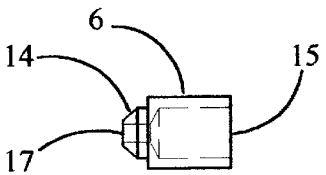
FIG. 2 shows a cable spacer used in the device.

A plurality of cable spacers 6, FIG. 2, each with a longitudinal aperture 17 there through is included. Each aperture 17 is sized so as to allow each cable spacer 6 to slide along the cable 5. The cable spacers 6 have a conical end portion 14 on one end of the cable spacer 6 and a second aperture concentric to the longitudinal aperture 17 forming an indented receiving portion 15 at an opposite end of the cable spacer 6. The conical end portion 14 and the indented receiving portion 15 are defined such that the conical end portion 14 of one of the cable spacers 6 is capable of detachably engaging the indented receiving portion 15 of an adjoining cable spacer 6.

The invention 10 also includes adjusting means for adjusting cable tension. The adjusting means is located proximate the means for holding the shaft to the handle and between the means for holding the shaft to the handle and the plurality of cable spacers 6. When the adjusting means is loosened, the shaft 10 is caused to become coilable as the cable spacers 6 separate and when the adjusting means is tightened, the shaft 10 is caused to become rigid as the cable spacers 6 are engaged with each other.

Figure 8:
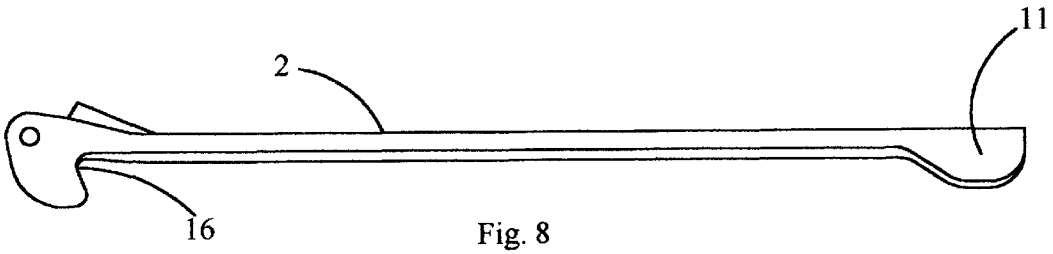
FIG. 8 is a cam lever used in the device.

The means for holding the shaft to the elongate hollow handle 1 is typically an elongate cam lever 2, FIG. 8, the elongate cam lever 2 being sized to slide inside the elongate hollow handle 1. The elongate cam lever 2 has a flared first end 11 and a cam shaped second end 16. The flared first end 11 is sized greater than an inside cross-sectional dimension 13 of the elongate hollow handle 1 such that the flared first end 11 acts as a stop for preventing said flared first end 11 from entering the elongate hollow handle 1. The upper cable end connector 4 is pivotally engaged to the cam shaped second end 16.

When the elongate cam lever 2 is pulled through the elongate hollow handle 2 from the flared first end 11, the elongate cam lever 2 is pivotally rotated to draw tension on the cable as the adjusting means engages the handle 1, thereby rendering the shaft rigid.

Figure 7:
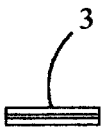
FIG. 7 shows a connecting pin used in the device.
Figure 5:
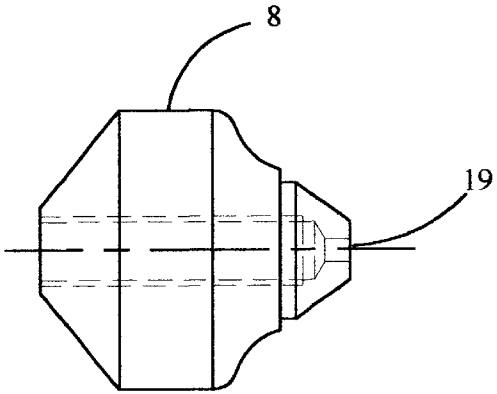
FIG. 5 shows the adjusting knob used in the device.
Figure 4:
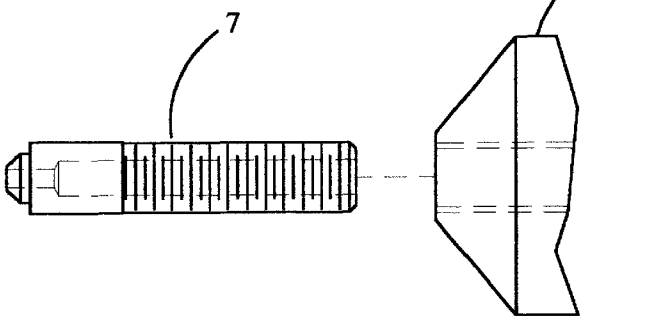
FIG. 4 shows the adjusting screw of the device.

The adjusting means for adjusting cable tension typically includes an adjusting screw 7, FIG. 7, having a hollow interior 18 for the slidable passage of the cable 5 there through, and a knob 8, FIG. 5, having a hollow interior 19 for the slidable passage of the cable 5 there through. The adjusting screw 7 is adjustably engagable with the adjusting knob 8 and has a conically shaped end 20 for engagement with the indented receiving portion 15 of an adjacent cable spacer 6.

The elongate hollow handle 1 preferably has an outwardly directed flared portion 21 at one end, and a notched portion 12 in the outwardly directed flared portion 21. The flared first end 11 of the elongate cam lever 2 engages the flared portion 21 thereby preventing the elongate cam lever 2 from further travel into the elongate hollow handle 1. The notched portion 12 typically extends into the handle 1 to the generally straight surface portion of the elongate hollow handle 1. In this configuration, the notched portion 12 serves to facilitate the folding over of the elongate cam lever 2 on to the elongate hollow handle 1 exterior surface by a cam action which locks the shaft 10 in a rigid position.

Figure 9:
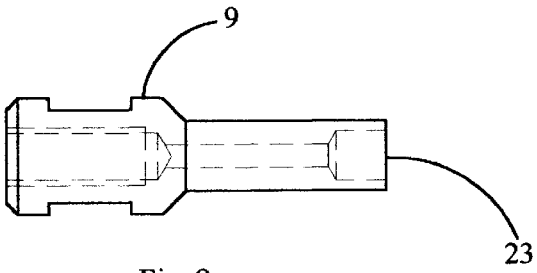
FIG. 9 the lower cable end of the device.

The invention 10 further comprises a lower cable end connector 9, FIG. 9, which is attached to the cable 5. The lower cable end connector 9 has means for detachably attaching an object 22 such as a spear, hook, magnet, tools such as screw drivers, socket sets, and many other working devices. The lower cable end connector 9 further has means for engaging and receiving the conical end portion 14 of an adjacent cable spacer 6. The means for engaging and receiving the conical end portion 14 of the adjacent cable spacer 6 is a second indented portion 23 sized to receive the conical end portion 14.

The upper cable end connector 4 and the lower cable end connector 9 is typically connected to each end of cable 5 by any of a number of means known in the art such as by clamping, crimping or swaging. Cable 5 is also known in the art as a wire rope.

The cable 5 is the component that pulls the spacers 6 together to form one solid assembly. The adjusting knob 8 has an adjusting screw 7 which typically threads into the adjusting knob 8, and is used to increase or decrease the tension on the cable 5. The adjusting knob 8 connects to the handle 1 acting as the housing for the adjusting screw 7 and as a hand stop. The upper cable end connector 4 is crimped to the cable upper end and is pivotally connected to the cam lever 2 by the connecting pin 3. The connecting pin 3, which is preferably a split pin as shown in FIG. 7, then acts as part of the cam assembly, and serves as the principal cam mechanism and locking device. The cable lower end connector 9 is crimp mounted to the lower portion of the cable 5 and serves as a spacer stop and mounting device for the application of attachments to the device.

In the construction of the components, particular attention should be paid to the construction of the cable spacers 6. Each spacer 6 has a cylindrical portion and a conical portion. The opening in the cylindrical portion is so sized as to receive the conical portion 14 of the previous cable spacer 6 so that the conical portion 14 of the previous spacer 6 can fit snugly in the opening but can readily leave the opening when this is desired. The adjusting knob 8 with its adjusting screw 7 is so sized as to accommodate the cable spacers 6.

The cable 5 may be a wire rope made from a variety of materials including wire strands of stainless steel, carbon steel, aluminum, among other suitable materials for the intended purpose known in the art. Each component, including the handle 1 to the cam lever 2, the knob 8, the screw 7, the split pin 3, the upper and lower cable end connectors 4,9, and the spacer 6 may be made from aluminum, carbon-steel, stainless steel, other metallic based materials, fiberglass, polymeric materials, and many other materials suitable for the intended purpose.

As seen from the foregoing description, the present invention satisfies a long felt need to provide a device which is readily made flexible for storage and readily made rigid for use in an almost unlimited number of situations as stated in the background of the invention section above.

The invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A multi-sectioned shaft comprising:

an elongate hollow handle;

the elongate hollow handle having means for holding a shaft to the elongate hollow handle;

the shaft including a cable with an upper cable end connector attaching the cable to the means for holding the shaft to the elongate hollow handle;

a plurality of cable spacers with a longitudinal aperture there through in each of the plurality of cable spacers, the aperture being sized so as to allow each cable spacer to slide along the cable, each of the plurality of cable spacers having a conical end portion on one end of the cable spacer and a second aperture concentric to the longitudinal aperture forming an indented receiving portion at an opposite end of the cable spacer, the conical end portion and the indented receiving portion defined such that the conical end portion of one of said plurality of cable spacers is capable of detachably engaging the indented receiving portion of an adjoining other cable spacer; and adjusting means for adjusting cable tension, the adjusting means being located proximate the means for holding the shaft to the handle and between the means for holding the shaft to the handle and the plurality of cable spacers, wherein when the adjusting means is loosened, the shaft is caused to become coilable as the cable spacers separate and when the adjusting means is tightened, the shaft is caused to become rigid as the cable spacers are engaged with each other.

2. The multi-sectioned shaft according to claim 1, wherein the means for holding the shaft to the elongate hollow handle comprises:

an elongate cam lever, the elongate cam lever being sized to slide inside the elongate hollow handle;

the elongate cam lever further having a flared first end and a cam shaped second end;

the flared first end being sized greater than an inside cross-sectional dimension of the elongate hollow handle such that the flared first end acts as a stop for preventing said flared first end from entering the elongate hollow handle;

the upper cable end connector being pivotally engaged to the cam shaped second end, wherein when the elongate cam lever is pulled through the elongate hollow handle from the flared first end, the elongate cam lever is pivotally rotated to draw tension on the cable as the adjusting means engages the handle, thereby rendering the shaft rigid.

3. The multi-sectioned shaft according to claim 1, wherein adjusting means for adjusting cable tension comprises:

an adjusting screw having a hollow interior for the slidable passage of the cable there through;

a knob having a hollow interior for the slidable passage of the cable there through;

the adjusting screw being adjustably engagable with the adjusting knob;

the adjusting screw having a conically shaped end for engagement with the indented receiving portion of an adjacent cable spacer.

4. The multi-sectioned shaft according to claim 2, wherein the elongate hollow handle further comprises:

an outwardly directed flared portion at one end; and a notched portion in said outwardly directed flared portion, wherein the flared first end of the elongate cam lever engages said flared portion of the elongate hollow handle thereby preventing the elongate cam lever from further travel into the elongate hollow handle, and wherein the notched portion facilitates the tensioning of the multi-sectioned shaft when the elongate cam lever is pulled from the flared portion of the elongate hollow handle and folded over such that the cam shaped second end engages the notched portion.

5. The multi-sectioned shaft according to claim 1, further comprising:

a lower cable end connector attached to the cable;

the lower cable end connector having means for detachably attaching an object; and the lower cable end connector further having means for engaging and receiving the conical end portion of an adjacent cable spacer.

6. The multi-sectioned shaft according to claim 5, wherein the means for engaging and receiving the conical end portion of the adjacent cable spacer is a second indented portion sized to receive the conical end portion.

* * * * *

UNITED STATES PATENT AND TRADEMARK OFFICE

CERTIFICATE OF CORRECTION

PATENT NO. : 6,378,168 B1 
DATED : April 30, 2002
INVENTOR(S) : Robert A. Brady and Joseph S. Murphy, III It is certified that error appears in the above-identified patent and that said Letters Patent is hereby corrected as shown below:

Column 3,
Line 20, replace "handle 2 from" with -- handle 1 from --.

Signed and Sealed this

Third Day of September, 2002

*Attest:*

*Attesting Officer*

JAMES E. ROGAN
*Director of the United States Patent and Trademark Office*